US012540621B2

(12) United States Patent
Baek et al.

(10) Patent No.: US 12,540,621 B2
(45) Date of Patent: Feb. 3, 2026

(54) ELECTRIC COMPRESSOR

(71) Applicant: Hanon Systems, Daejeon (KR)

(72) Inventors: Chan Ho Baek, Daejeon (KR); Hyo Keun Jeon, Daejeon (KR); Kyung Ah Hong, Daejeon (KR); Sae Bom Kim, Daejeon (KR); Gwang Hoon Song, Daejeon (KR); Suk Jae Chung, Daejeon (KR)

(73) Assignee: Hanon Systems, Daejeon (KR)

( * ) Notice: Subject to any disclaimer, the term of this patent is extended or adjusted under 35 U.S.C. 154(b) by 0 days.

(21) Appl. No.: 18/727,276

(22) PCT Filed: Feb. 23, 2023

(86) PCT No.: PCT/KR2023/002628
§ 371 (c)(1),
(2) Date: Jul. 8, 2024

(87) PCT Pub. No.: WO2023/191316
PCT Pub. Date: Oct. 5, 2023

(65) Prior Publication Data

US 2025/0084847 A1 Mar. 13, 2025

(30) Foreign Application Priority Data

Mar. 31, 2022 (KR) ..... 10-2022-0040576

(51) Int. Cl.
*F04C 29/04* (2006.01)
*F04C 18/02* (2006.01)
*F04C 23/02* (2006.01)

(52) U.S. Cl.
CPC ..... *F04C 29/04* (2013.01); *F04C 18/0215* (2013.01); *F04C 23/02* (2013.01)

(58) Field of Classification Search
CPC ..... B60H 1/32; B60H 1/3222; F04C 18/0215; F04C 23/008; F04C 23/02; F04C 29/0085;
(Continued)

(56) References Cited

U.S. PATENT DOCUMENTS 8,587,168 B2 * 11/2013 Yamada ..... F04C 23/008 310/43
8,602,752 B2 * 12/2013 Horiba ..... H02K 3/38 417/410.5
(Continued)

FOREIGN PATENT DOCUMENTS

JP 11027883 A 1/1999
JP 4687810 B2 5/2011
(Continued)

OTHER PUBLICATIONS

Machine Translation JPH1127883 (Year: 2025).*
Machine Translation KR 1020110131742 (Year: 2025).*

*Primary Examiner* — Dapinder Singh
(74) *Attorney, Agent, or Firm* — James D. Miller; Shumaker, Loop & Kendrick, LLP

(57) ABSTRACT

An electric compressor including: a rotating shaft configured to drive a compression mechanism; a rotor configured to have a rotating shaft through-hole into which the rotating shaft is inserted; a cover configured to cover a longitudinal end of the rotor; and a stator configured to be installed on a radially outer side of the rotor. A plurality of slots into which a permanent magnet is inserted is formed to be spaced apart from each other in the rotor in a circumferential direction of the rotor. A cooling hole is formed in both ends of the slot, and the slot and the cooling hole are spatially separated. Refrigerant flows into the cooling hole and cools the per-
(Continued)

manent magnet. Accordingly, it is possible to improve the cooling performance of the permanent magnet.

11 Claims, 15 Drawing Sheets

(58) Field of Classification Search
CPC .... F04C 29/04; F04C 29/045; F04C 2240/10; F04C 2240/20; F04C 2240/40; F04C 2240/60; F04C 2240/807; F05B 2210/14; F05B 2240/10; F05B 2240/20; F05B 2240/60; H02K 1/32; H02K 5/20; H02K 9/12
See application file for complete search history.

(56) References Cited

U.S. PATENT DOCUMENTS

| | | | | |
|---|---|---|---|---|
| 2008/0317614 | A1* | 12/2008 | Horiba | F04C 23/008 417/410.3 |
| 2011/0268593 | A1* | 11/2011 | Yamada | F04B 35/04 310/55 |
| 2016/0160861 | A1* | 6/2016 | Ichise | F04C 29/028 418/55.6 |
| 2021/0062808 | A1* | 3/2021 | Hattori | F04C 18/0215 |
| 2021/0062811 | A1* | 3/2021 | Yamashita | F04C 23/008 |
| 2022/0173626 | A1* | 6/2022 | Hagita | F25B 31/026 |

FOREIGN PATENT DOCUMENTS

| | | | |
|---|---|---|---|
| JP | 6571293 | B2 | 9/2019 |
| KR | 1020110131742 | A | 12/2011 |
| KR | 101420080 | B1 | 7/2017 |

* cited by examiner

ELECTRIC COMPRESSOR

CROSS REFERENCE TO RELATED PATENT APPLICATIONS

This is a U.S. national phase patent application of PCT/KR2023/002628 filed Feb. 23, 2023 which claims the benefit of and priority to Korean Patent Application No. 10-2022-0040576 filed on Mar. 31, 2022, the entire contents of each of which are incorporated herein by reference.

TECHNICAL FIELD

The present disclosure relates to an electric compressor and more particularly to an electric compressor for a vehicle, which is driven by a motor.

BACKGROUND ART

Generally, an air conditioning (A/C) system for heating and cooling the interior of a vehicle is installed in the vehicle. This air conditioning system includes a compressor as a component of a cooling system. The compressor compresses a low-temperature and low-pressure gaseous refrigerant drawn from an evaporator into a high-temperature and high-pressure gaseous refrigerant and transmits it to a condenser.

A compressor applied to the air conditioning system for a vehicle includes a swash plate compressor that uses the power of an engine and an electric compressor that drives a compression mechanism by a motor.

According to the motor cooling structure of a conventional general electric compressor, since the refrigerant passes only through the outside of the rotor, the inside of the rotor is not sufficiently cooled. In particular, the cooling effect of a permanent magnet inserted inside the rotor is limited. Demagnetization may occur in a neodymium magnet used as a permanent magnet at high temperatures. This deteriorates the performance of the motor. Therefore, sufficient cooling of the rotor, especially the permanent magnet, is essential.

SUMMARY

The embodiment of the present disclosure is designed to solve the problems of the motor cooling structure of the conventional electric compressor. The purpose of the present disclosure is to provide an electric compressor capable of improving the cooling performance of a permanent magnet.

One embodiment is an electric compressor including: a compression mechanism configured to include a fixed scroll and an orbiting scroll disposed to be engaged with the fixed scroll; a rotating shaft configured to drive the orbiting scroll; a rotor configured to have a rotating shaft through-hole into which the rotating shaft is inserted; a cover configured to cover a longitudinal end of the rotor; and a stator configured to be installed on a radially outer side of the rotor. A plurality of slots into which a permanent magnet is inserted is formed in the rotor in a circumferential direction of the rotor. A cooling hole is formed in both ends of the slot, and a partition wall is formed the slot and the cooling hole. Refrigerant flows into the cooling hole.

A refrigerant through-hole communicating with the cooling hole may be formed in the cover.

A balance weight may be attached to the cover, and the balance weight may be located such that the refrigerant through-hole is opened.

The refrigerant through-hole may be opened in such a manner as to be inclined by a protrusion protruding from the cover. The refrigerant through-hole may be formed by opening one side of the protrusion protruding from the cover.

The refrigerant through-hole may be opened in a direction matching a rotation direction of the refrigerant.

A balance weight may be attached to the cover. In order to avoid interference with the protrusion, the balance weight may be formed by combining a plurality of metal layers of which a portion of edges is curved, and the metal layer adjacent to the cover may be formed such that the curved edge is positioned more inward than the protrusion in a radial direction of the rotor.

The balance weight may include: a first stage which is composed of a metal layer adjacent to the cover and forms a curved edge more inward than the protrusion in the radial direction of the rotor; and a second stage which is connected to the first stage on the opposite side of the cover and extends outward in the radial direction of the rotor to form the curved edge corresponding to an outer surface of the cover.

The cooling hole may include: a first wall formed on the slot side; a second wall formed in the circumferential direction of the rotor; and a third wall connecting the first wall and the second wall. The first wall and the slot may be spaced.

An edge formed when the second wall and the third wall meet each other may be formed to be opened, so that the refrigerant flowing outside the rotor is able to flow into the cooling hole.

The cooling hole may be formed as a single space located between the two adjacent slots, so that the refrigerant flowing through the cooling hole cools the permanent magnets located on both sides of the cooling hole.

The cooling hole may include: a first wall and a second wall which are formed on the two adjacent slot sides, respectively; a third wall connecting one ends of the first wall and the second wall; and a fourth wall connecting the other ends of the first wall and the second wall.

A refrigerant through-hole communicating with the cooling hole may be formed in the cover.

According to the embodiment, it is possible to improve the cooling performance of a permanent magnet.

Also, through the improvement of the cooling performance of the permanent magnet, demagnetization caused by overheating of the permanent magnet can be prevented. The prevention of the demagnetization phenomenon can stably maintain the performance of the motor without degrading the performance of the motor, so that the overall performance or reliability of the electric compressor can be enhanced.

DESCRIPTION OF AN EMBODIMENT

Hereinafter, an electric compressor according to an embodiment of the present disclosure will be described with reference to the accompanying drawings.

First, the structure of the electric compressor or scroll compressor to which the present invention is applied will be described with reference to FIG. 1.

Figure 1:
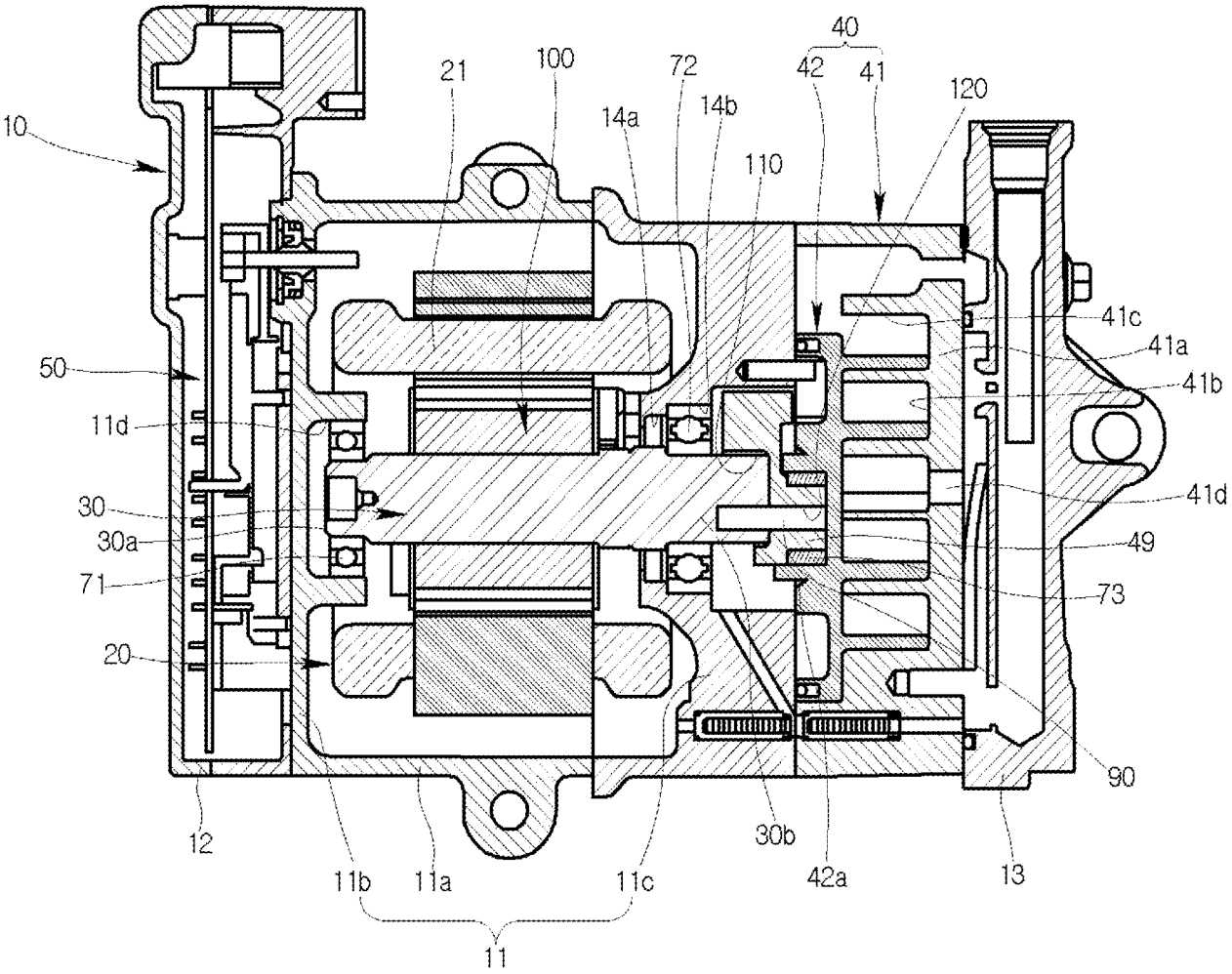
FIG. 1 is a cross-sectional view showing a structure of an electric compressor according to an embodiment of the present disclosure.

Referring to FIG. 1, the electric compressor or scroll compressor to which the present invention is applied may include a casing 10, a motor 20 that generates a driving force within the casing 10, a rotating shaft 30 that is rotated by the motor 20, and a compression mechanism 40 that is driven by the rotating shaft 30 and compresses a refrigerant.

The casing 10 may include a first housing 11 receiving the motor 20, a second housing 12 receiving an inverter 50 that controls the motor 20, and a third housing 13 receiving the compression mechanism 40.

The first housing 11 includes an annular wall 11*a*, a first partition wall 11*b* covering one end of the annular wall 11*a*, and a second partition wall 11*c* covering the other end of the annular wall 11*a*. The annular wall 11*a*, the first partition wall 11*b*, and the second partition wall 11*c* may form a motor receiving space that receives the motor 20.

The second housing 12 may be coupled to the first partition wall 11*b* side and may form an inverter receiving space that receives the inverter 50.

The third housing 13 may be coupled to the second partition wall 11*c* side and may form a compression space that receives the compression mechanism 40.

Here, the second partition wall 11*c* divides the motor receiving space and the compression space and serves as a main frame that supports the compression mechanism 40. A shaft receiving hole 14*a* through which the rotating shaft 30 that interlocks the motor 20 and the compression mechanism 40 passes may be formed on the center side of the second partition wall 11*c*.

Meanwhile, a fixed scroll 41 of the compression mechanism 40 may be fastened to the second partition wall 11*c*, and the third housing 13 may be fastened to the fixed scroll 41. However, the embodiment is not limited to this. The third housing 13 may receive the compression mechanism 40 and may be fastened to the second partition wall 11*c*.

The motor 20 may include a stator 21 fixed to the first housing 11 and a rotor 100 that is rotated by interaction with the stator 21 within the stator 21.

The rotating shaft 30 may pass through the center of the rotor 100. One end of the rotating shaft 30 may protrude toward the first partition wall 11*b* side with respect to the rotor 100, and the other end of the rotating shaft 30 may protrude toward the second partition wall 11*c* side with respect to the rotor 100.

One end 30*a* of the rotating shaft 30 may be rotatably supported on a first bearing 71 provided on the center side of the first partition wall 11*b*.

Here, the first bearing 71 and a first support groove 11*d* into which one end of the rotating shaft 30 is inserted may be formed on the center side of the first partition wall 11*b*, and the first bearing 71 may be interposed between the first support groove 11*d* and one end of the rotating shaft 30.

The other end 30*b* of the rotating shaft 30 may pass through the shaft receiving hole 14*a* of the second partition wall 11*c* and be connected to the compression mechanism 40.

Also, an eccentric bush 49 is connected to the other end 30*b* of the rotating shaft 30 by a connecting pin 90. The eccentric bush 49 may be rotatably supported on a third bearing 73 provided on the compression mechanism 40. Also, the eccentric bush 49 transmits a rotational force to an orbiting scroll 42 in connection with the third bearing 73.

Here, a second support groove 14*b* in which a second bearing 72 is disposed may be formed in the shaft receiving hole 14*a* of the second partition wall 11*c*. The second bearing 72 may be interposed between the second support groove 14*b* and the rotating shaft 30.

Also, a boss portion 42*a* into which the third bearing 73 and the eccentric bush 49 are inserted may be formed on the orbiting scroll 42 of the compression mechanism 40. The third bearing 73 may be interposed between the boss portion 42*a* and the eccentric bush 49.

The compression mechanism 40 may include the fixed scroll 41 and the orbiting scroll 42. The fixed scroll 41 is fixedly coupled to the second partition wall 11*c* on the opposite side of the motor 20 with respect to the second partition wall 11*c*. The orbiting scroll 42 is provided between the second partition wall 11*c* and the fixed scroll 41 and is engaged with the fixed scroll 41 to form a pair of two compression chambers and is orbitally moved by the rotating shaft 30.

The fixed scroll 41 may include a disk-shaped fixed head 41*a* and a fixed wrap 41*c* that protrudes from a compression surface 41*b* of the fixed head 41*a* and is engaged with the orbiting scroll 42.

A discharge port 41*d* may be formed on the center side of the fixed head 41*a*. The discharge port 41*d* passes through the fixed head 41*a* and discharges the refrigerant compressed in the compression chamber. Here, the discharge port 41*d* may communicate with a discharge space formed between the fixed scroll 41 and the third housing 13.

In the scroll compressor according to such a configuration, when power is applied to the motor 20, the rotating shaft 30 may transmit a rotational force to the orbiting scroll 42 while rotating together with the rotor 100. Then, the orbiting scroll 42 is orbitally moved by the rotating shaft 30, so that the volume of the compression chamber be reduced as the compression chamber is continuously moved toward the center side. Then, the refrigerant may flow into the motor receiving space through a refrigerant inlet (not shown) formed in the annular wall 11*a* of the first housing 11. Then, the refrigerant in the motor receiving space may be sucked into the compression chamber through a refrigerant passage hole (not shown) formed in the second partition wall 11*c* of the first housing 11. Then, the refrigerant sucked into the compression chamber may be compressed while moving toward the center side along the moving path of the compression chamber and may be discharged to the discharge space through the discharge port 41*d*. A process in which the refrigerant discharged to the discharge space is discharged to the outside of the scroll compressor through a refrigerant discharge port formed in the third housing 13 is repeated.

In this process, the rotating shaft 30 is rotatably supported by the first bearing 71 and the second bearing 72, and the orbiting scroll 42 is rotatably supported by the third bearing 73 with respect to the rotating shaft 30. The third bearing 73 may be formed with the bearing 73 that is different from the first bearing 71 and the second bearing 72 in order to reduce the weight and size of an assembly (hereinafter, orbiting body) of the third bearing 73 and the orbiting scroll 42.

Specifically, the first bearing 71 and the second bearing 72 which are fixed to the casing 10 may each be formed as a ball bearing in order to minimize friction loss.

On the other hand, the third bearing 73 that is in a proportional relationship with the weight and size of the orbiting body as it is orbitally moved together with the orbiting scroll 42 may be formed as a slide bush bearing or a needle roller bearing which is smaller in weight and size than a ball bearing and is less expensive. Also, the third bearing 73 may be press-fitted into the boss portion 42*a* with a predetermined press-fit force.

First Embodiment

Hereinafter, an electric compressor according to a first embodiment of the present disclosure will be described with reference to FIGS. 2 to 6.

Figure 2:
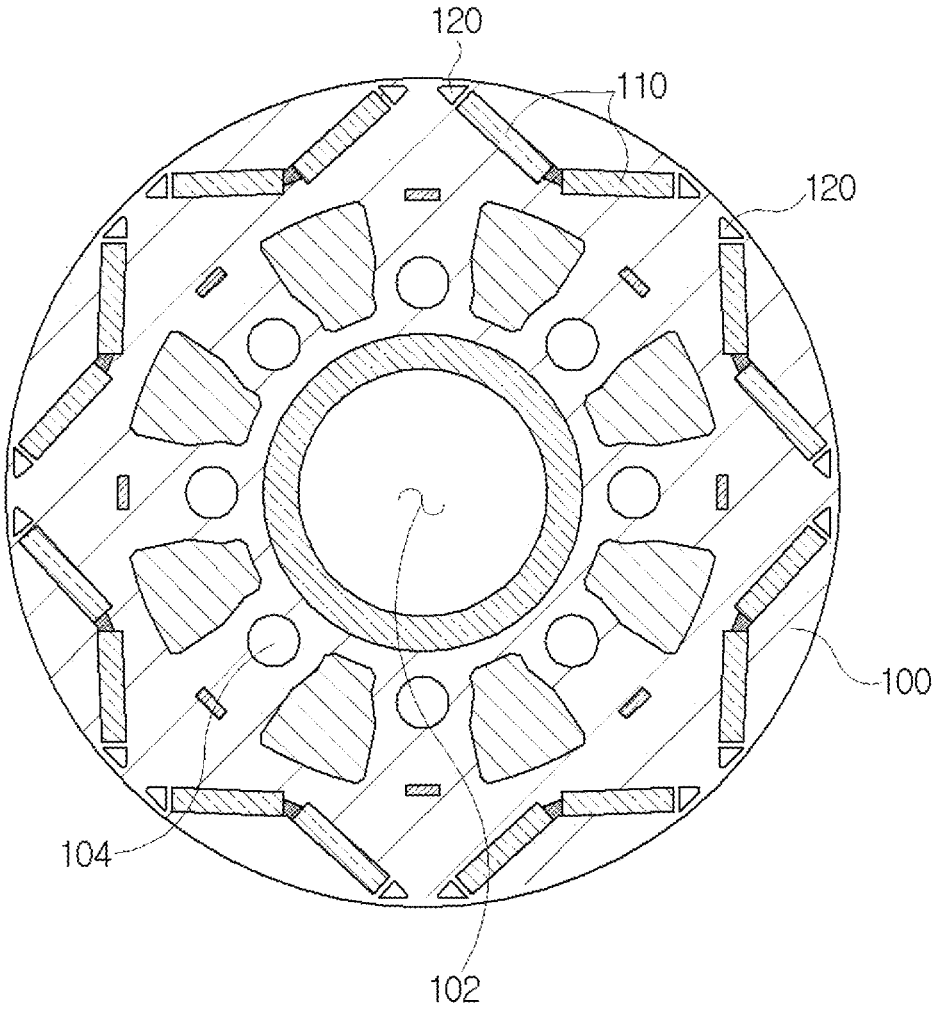
FIG. 2 is a cross-sectional view showing a rotor in the electric compressor according to a first embodiment of the present disclosure.
Figure 3:
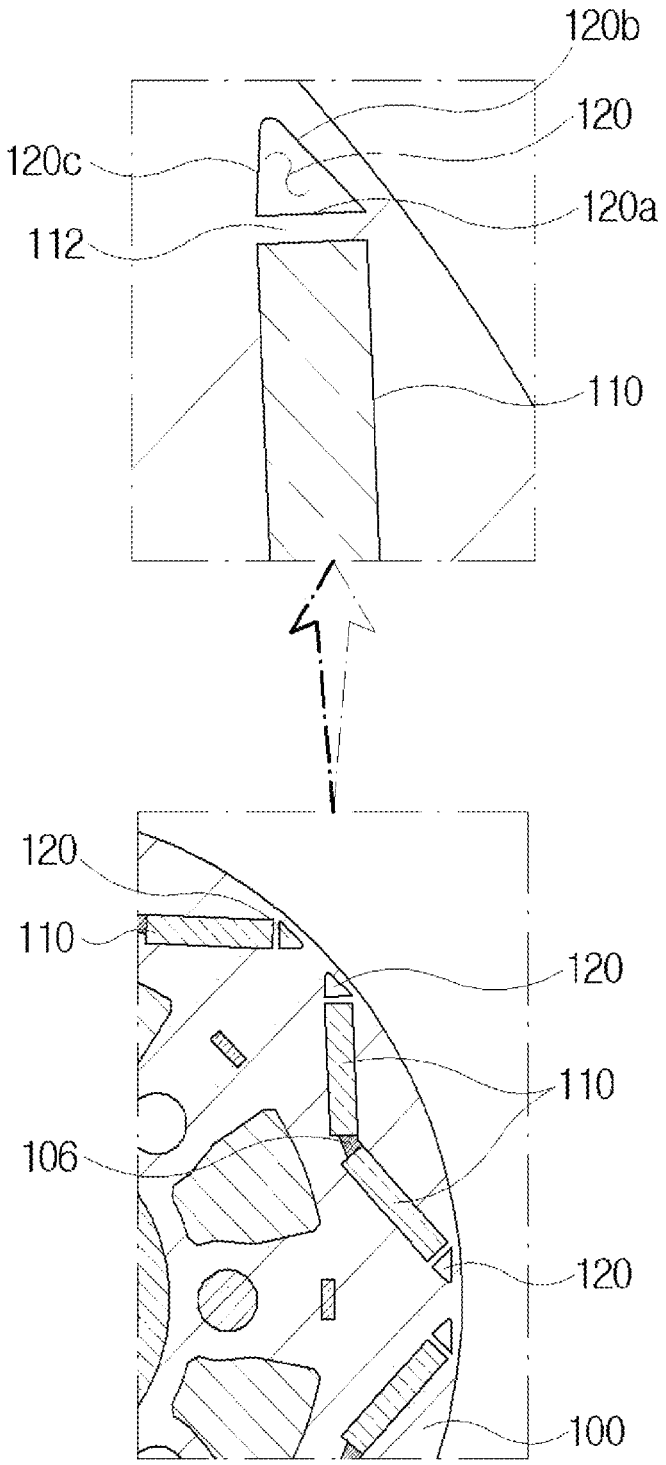
FIG. 3 is an enlarged cross-sectional view of FIG. 2.
Figure 4:
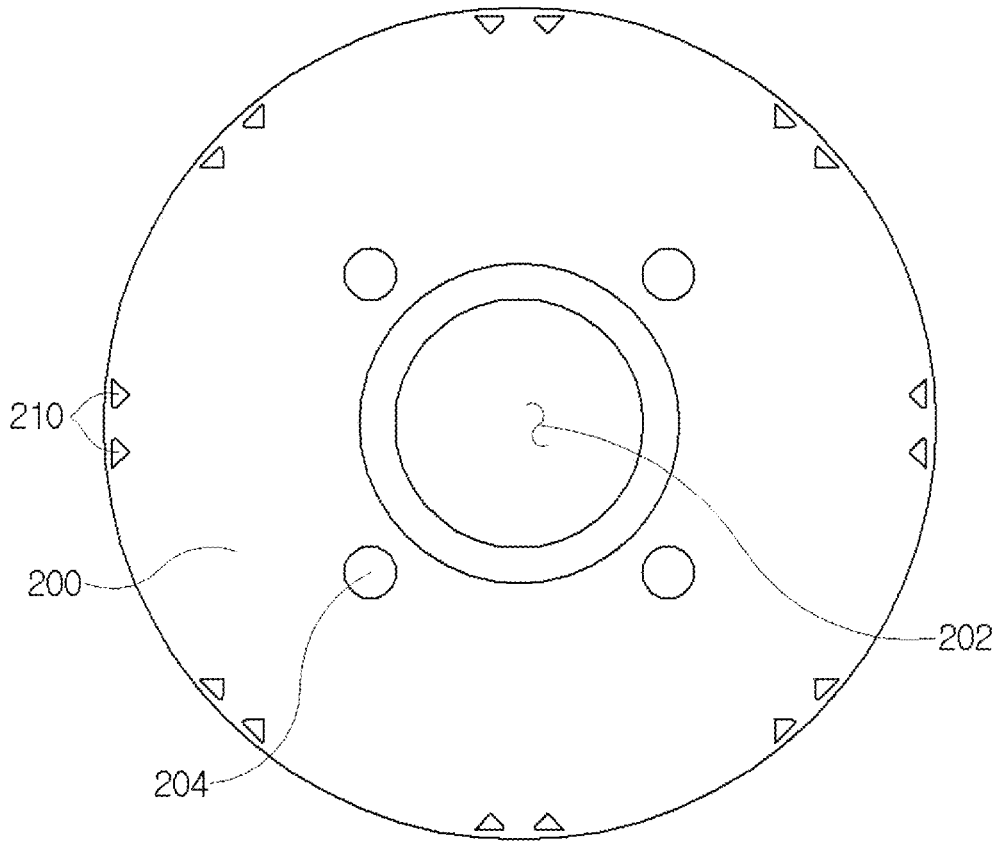
FIG. 4 is a plan view showing a cover of the rotor in the electric compressor according to the first embodiment of the present disclosure.
Figure 5:
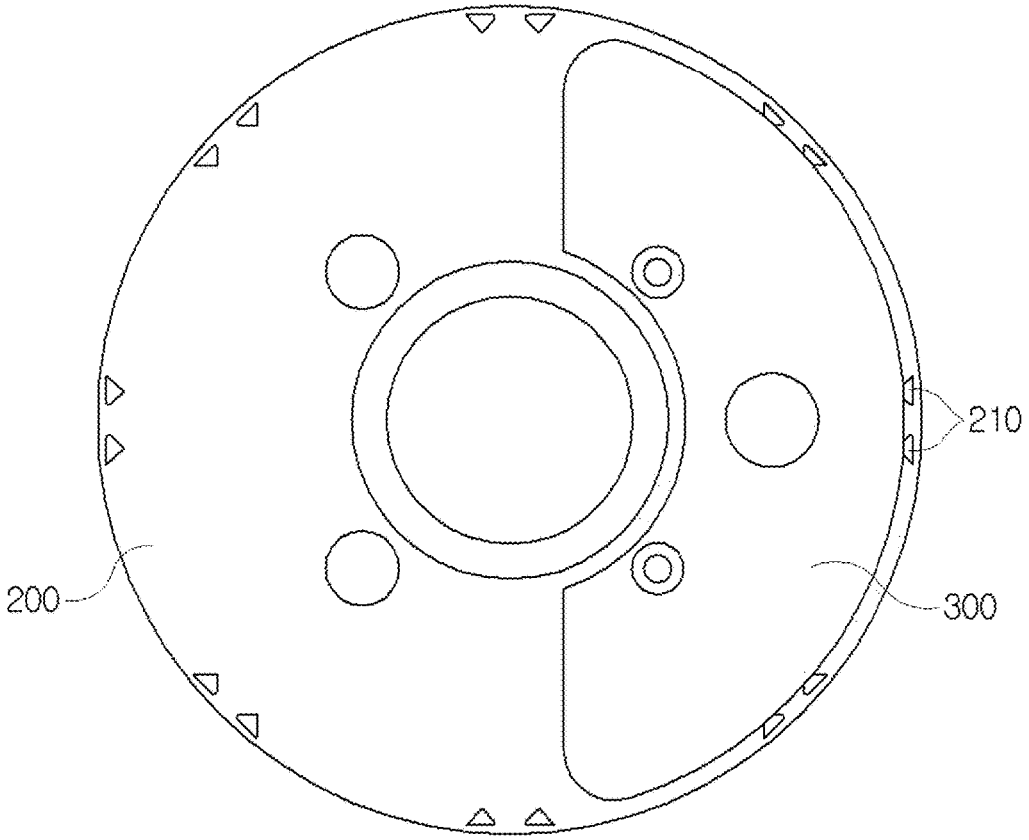
FIG. 5 is a plan view showing a state where a balance weight is attached to FIG. 4.
Figure 6:
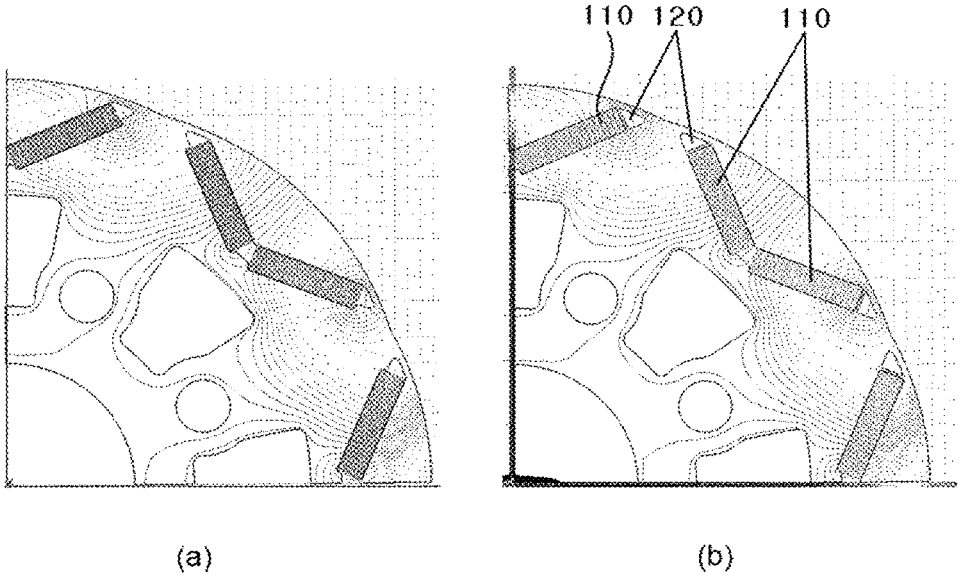
FIG. 6 is a view showing that a magnetic flux line diagram of the electric compressor according to the first embodiment of the present disclosure is compared with a magnetic flux line diagram of a conventional electric compressor.

FIG. 2 is a cross-sectional view showing a rotor in the electric compressor according to a first embodiment of the present disclosure. FIG. 3 is an enlarged cross-sectional view of FIG. 2. FIG. 4 is a plan view showing a cover of the rotor in the electric compressor according to the first embodiment of the present disclosure. FIG. 5 is a plan view showing a state where a balance weight is attached to FIG. 4. FIG. 6 is a view showing that a magnetic flux line diagram of the electric compressor according to the first embodiment of the present disclosure is compared with a magnetic flux line diagram of a conventional electric compressor.

Referring to FIGS. 2 to 5, the electric compressor according to the embodiment includes the compression mechanism 40, the rotating shaft 30, the rotor 100, a cover 200, the stator 21, and a balance weight 300.

As described above, the compression mechanism 40 may include the fixed scroll 41 and the orbiting scroll 42. The orbiting scroll 42 may be engaged with and connected to the fixed scroll 41 and compress a refrigerant while being rotated by the rotating shaft 30. For detailed descriptions of this, reference is made to the above descriptions.

The rotor 100 has a donut shape with a rotating shaft through-hole 102 formed in the middle thereof, and the rotor 100 may be formed in a structure in which a plurality of steel plates is stacked.

As the rotating shaft 30 passes through the rotating shaft through-hole 102, the rotor 100 and the rotating shaft 30 rotate together. The stator 21 is installed on the radially outer side of the rotor 100. The rotor 100, the rotation shaft coupled to the rotor 100, and the stator 21 are collectively referred to as a motor.

A plurality of fastening holes 104 are formed around the rotating shaft through-hole. The fastening hole 104 is a hole into which a fastener that penetrates and couples the rotor 100 and the cover 200 together is inserted.

A plurality of slots 106 is formed in the rotor 100 in the circumferential direction of the rotor. The slot 106 is formed in a V shape, and the different slots 106 are spaced apart in the circumferential direction. A permanent magnet 110 is inserted into the slot 106. A pair of permanent magnets 110 are arranged in a V shape in one slot 106. A pair of permanent magnets 110 inserted into one slot 106 are spaced apart from each other.

A longitudinal end of the slot 106 is closed by a partition wall 112. A cooling hole 120 is located on the opposite side of the partition wall 112. The partition wall 112 may be formed between the slot 106 and the cooling hole 120.

The cooling hole 120 is formed in the longitudinal direction of the permanent magnet 110. The location and size of the cooling hole 120 may be designed in consideration of the magnetic force lines of the permanent magnet 110. The slot 106 and the cooling hole 120 are mutually separated spaces, and the refrigerant flowing through the cooling hole 120 does not directly contact the permanent magnet 110.

However, the cooling hole 120 is not intended only to perform a cooling function, but serves as a barrier which is a path through which the magnetic flux of the permanent magnet 110 flows and prevents magnetic flux leakage. If the magnetic flux generated from one end of the permanent magnet 110 is not blocked, this may affect the stator 21. Therefore, the barrier is formed at one end of the permanent magnet 110, and the cooling hole 120 is formed at one end of the permanent magnet 110 in order to function as such a barrier.

In the conventional electric compressor, the barrier is formed integrally with the slot 106. Unlike this, in the embodiment, the slot 106 and the cooling hole 120 are separated, and a side effect in which impurities contained in the refrigerant are attached to the permanent magnet 110 is prevented while maintaining the cooling effect on the permanent magnet 110. The impurities that may be contained in the refrigerant are metallic substances that inevitably exist within the compressor. Therefore, if these fine foreign substances are attached to the permanent magnet 110, the permanent magnet 110 cannot function normally, which results in the deterioration of the performance of the motor. Therefore, such a problem is prevented by separating the cooling hole 120 from the slot 106.

As shown in FIG. 3, the cooling hole 120 includes a first wall 120*a* formed on the slot 106 side, a second wall 120*b* formed in the circumferential direction of the rotor 100, and a third wall 120*c* connecting the first wall 120*a* and the second wall 120*b*. The first wall 120*a* and the slot 106 are formed with the partition wall 112 placed therebetween. The first to third walls 120*a*, 120*b*, and 120*c* roughly form a triangle. However, these walls are not necessarily formed as flat surfaces and may be formed to include curved surfaces.

Referring to FIG. 6, it can be seen that there is no significant difference in the magnetic flux line diagram when comparing a structure (a) in which the barrier is formed integrally with the slot 106 and the present embodiment (b). That is, it can be found that even if the cooling hole 120 and the slot 106 are separated by the partition wall 112, there is no significant change in the magnetic flux line diagram of the permanent magnet 110 and the barrier function of the cooling hole 120 is maintained.

A rotation shaft through-hole 202 through which the rotation shaft passes is formed in the middle of the cover 200, and a plurality of fastening holes 204 is formed on the radially outer side of the rotation shaft through-hole 202. A fastener that couples the cover 200 and the rotor 100 is inserted into the fastening hole 204.

A refrigerant through-hole 210 communicating with the cooling hole 120 is formed in the cover 200. The refrigerant through-hole 210 has a shape corresponding to the cooling hole 120. Since the cover 200 is coupled to both ends of the rotor 100, the refrigerant through-hole 210 is formed in both of a pair of the covers 200. The refrigerant through-hole 210 serves as an inlet and an outlet of the refrigerant flowing into the cooling hole 120.

The balance weight 300 is attached to the cover 200. The balance weight 300 is attached so as to prevent vibration due to weight variation when the rotor 100 rotates at a high speed. The balance weight 300 is attached to both longitudinal ends of the rotor 100 and at the outside of the cover 200. However, as shown in FIG. 5, the balance weight 300 is attached more inside than the refrigerant through-hole 210 such that the refrigerant through-hole 210 is not blocked by the balance weight 300.

In the electric compressor according to the embodiment, the refrigerant enters the refrigerant through-hole 210 formed in one side cover 200, passes through the cooling hole 120, and comes out of the refrigerant through-hole 210 formed in the opposite cover 200. The cooling hole 120 is formed in one side of the slot 106, so that the refrigerant can sufficiently cool the permanent magnet 110.

In addition to the refrigerant flowing into the cooling hole 120, there is basically also a refrigerant flowing outside the rotor 100. The embodiment intends that the cooling hole 120 is further formed within the rotor 100 in addition to the existing refrigerant flow, so that the permanent magnet 110 is cooled more effectively.

The refrigerant that has passed through the cooling hole 120 is compressed in the compression mechanism 40 and then is discharged to the outside of the housing of the electric compressor through a discharge chamber.

Second Embodiment

Hereinafter, an electric compressor according to a second embodiment of the present disclosure will be described with reference to FIGS. 7 to 10.

Figure 7:
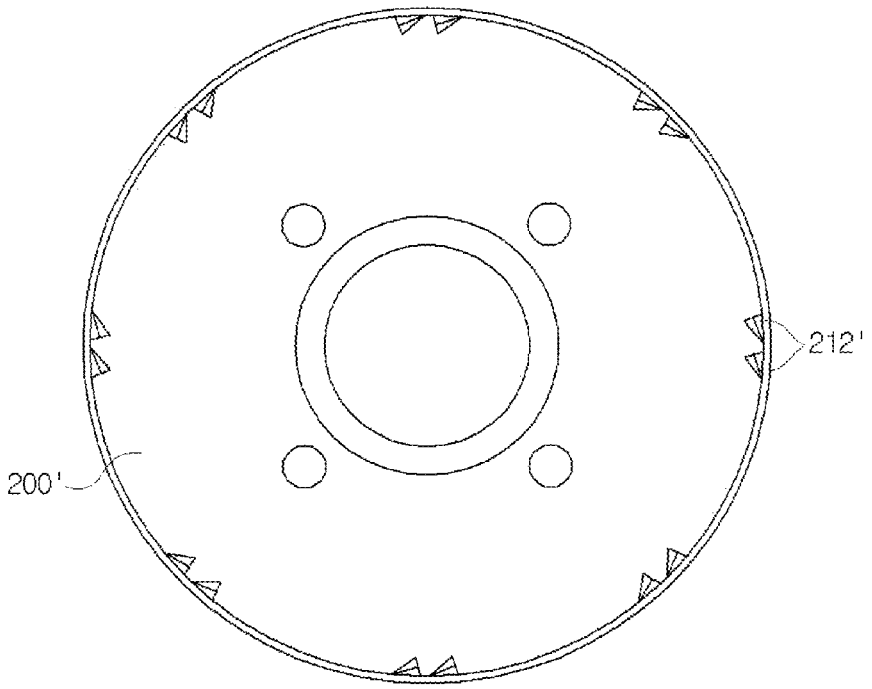
FIG. 7 is a plan view showing a cover of a rotor in an electric compressor according to a second embodiment of the present disclosure.
Figure 8:
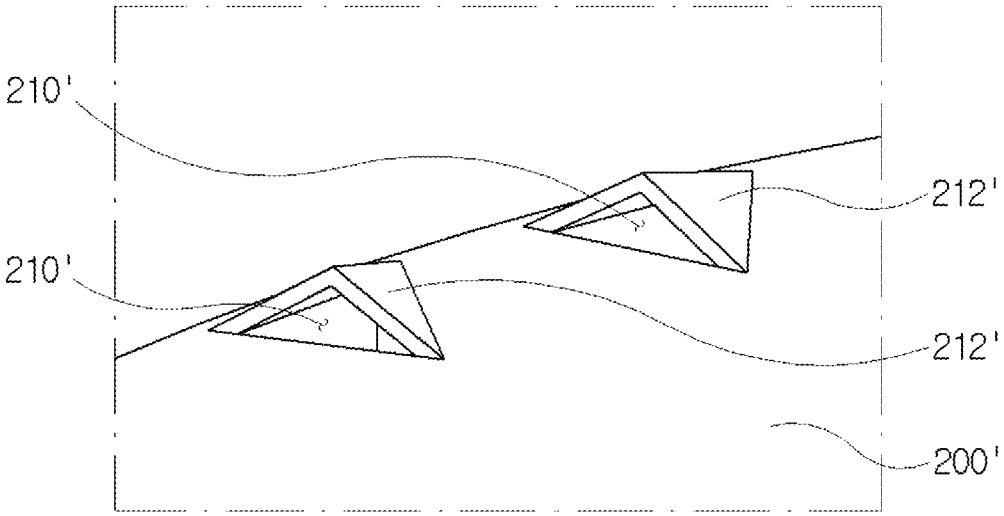
FIG. 8 is a perspective view showing a refrigerant through-hole of FIG. 7.
Figure 9:
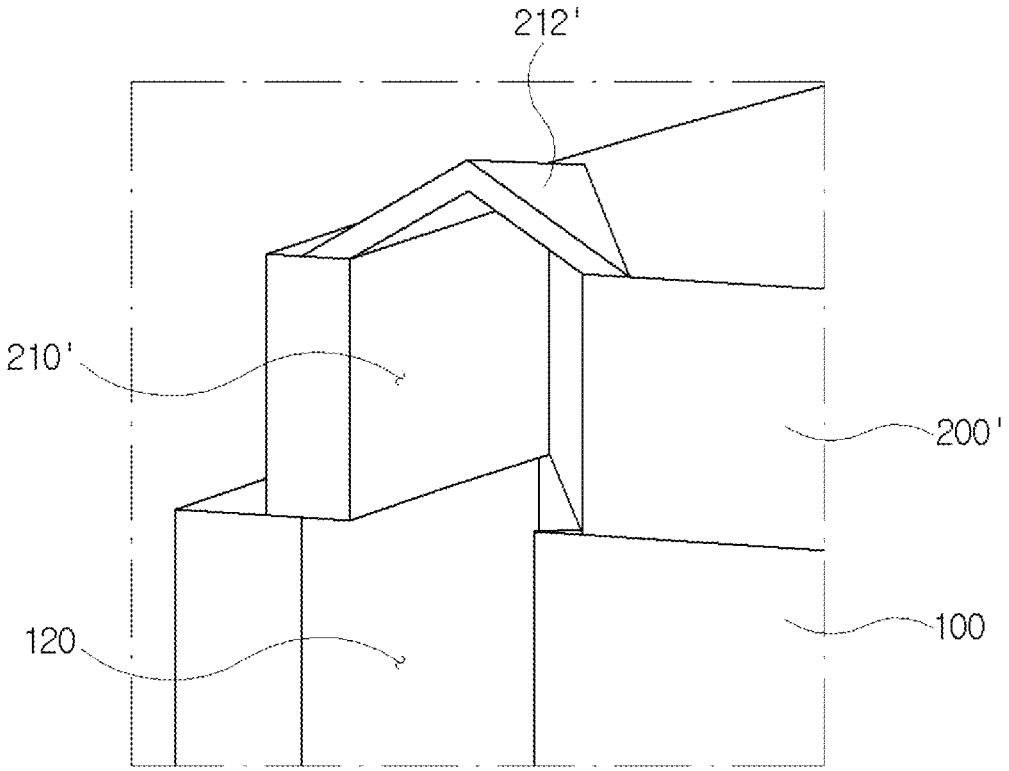
FIG. 9 is a perspective dissection view showing a cooling hole and the refrigerant through-hole in the electric compressor according to the second embodiment of the present disclosure.
Figure 10:
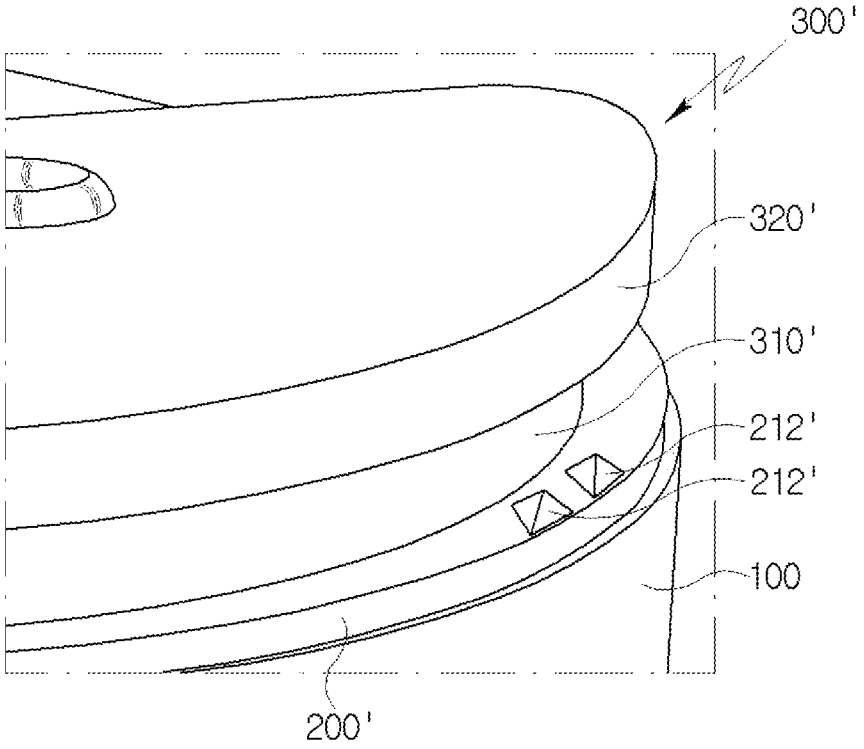
FIG. 10 is a perspective view showing a state where a balance weight is attached to the cover of the rotor in the electric compressor according to the second embodiment of the present disclosure.

FIG. 7 is a plan view showing a cover of a rotor in an electric compressor according to a second embodiment of the present disclosure. FIG. 8 is a perspective view showing a refrigerant through-hole of FIG. 7. FIG. 9 is a perspective dissection view showing a cooling hole and the refrigerant through-hole in the electric compressor according to the second embodiment of the present disclosure. FIG. 10 is a perspective view showing a state where a balance weight is attached to the cover of the rotor in the electric compressor according to the second embodiment of the present disclosure.

As shown in FIGS. 7 and 8, a protrusion 212' is formed on the cover 200' of the electric compressor according to the second embodiment of the present disclosure. The protrusion 212' allows a refrigerant through-hole 210' to be opened in such a manner as to be inclined to one side. That is, the protrusion 212' plays a similar role to that of a cover or roof of the refrigerant through-hole 210'. The protrusion 212' has a three-dimensional shape where two inclined surfaces meet each other and is formed integrally with the cover 200'.

Here, the refrigerant through-hole 210' may be formed by opening one side of the protrusion 212' protruding from the cover 200. Also, the direction in which the refrigerant through-hole 210' is opened may match the rotation direction of the refrigerant.

The refrigerant flowing from one side to the other side of the rotor 100 while the compressor is running does not flow straight but flows while rotating in one direction. Therefore, in the embodiment, the protrusion 212' is formed, and thus, the refrigerant through-hole 210' is opened obliquely in the circumferential direction of the cover 200', so that the refrigerant flows easily into the refrigerant through-hole 210'. This produces an effect of increasing the flow rate of the refrigerant passing through the cooling hole 120.

As shown in FIG. 9, the refrigerant through-hole 210' and the cooling hole 120 are in communication with each other in the same manner as in the first embodiment described above. That is, the refrigerant through-hole 210' serves as the inlet and outlet of the cooling hole 120. Therefore, when the refrigerant flowing outside of the cover 200' in an orbital manner flows into the refrigerant through-hole 210', the refrigerant flows into the cooling hole 120, and the permanent magnet 110 is cooled.

As shown in FIG. 10, a balance weight 300' is attached to the cover 200'. The balance weight 300' may be formed by combining a plurality of metal layers having some curved edges. Also, the metal layer adjacent to the cover 200 in the balance weight 300' may be formed such that the curved edge is positioned more inward than the protrusion 212' in a radial direction of the rotor.

In the embodiment, the balance weight 300' is composed of two stages.

The first stage 310' may be composed of a metal layer adjacent to the cover 200 and may form a curved edge more inward than the protrusion in the radial direction of the rotor 100.

The second stage 320' may be connected to the first stage 310' on the opposite side of the cover 200, and may extend outward in the radial direction of the rotor 100 to form a curved edge corresponding to the outer surface of the cover 200.

Here, the size of the first stage 310' in contact with the cover 200' is smaller than the size of the second stage 320'. This intends to avoid interference between the balance weight 300' and the protrusion. The balance weight 300' must have an appropriate weight for its original function. Therefore, if the overall size of the balance weight 300' is reduced, the balance weight 300' may not obtain the weight. Therefore, in the embodiment, the balance weight 300' has a two-stage structure having a shape obtained by shaving a lower portion of the balance weight 300', and avoids the interference with the protrusion while maintaining the weight thereof, thereby allowing the refrigerant to easily flow into the refrigerant through-hole 210'.

In the second embodiment described above, the rotor 100 excluding the cover 200', and the cooling hole 120 formed in the rotor 100, etc., are the same as those described above in the first embodiment.

Third Embodiment

Hereinafter, an electric compressor according to a third embodiment of the present disclosure will be described with reference to FIGS. 11 to 13.

Figure 11:
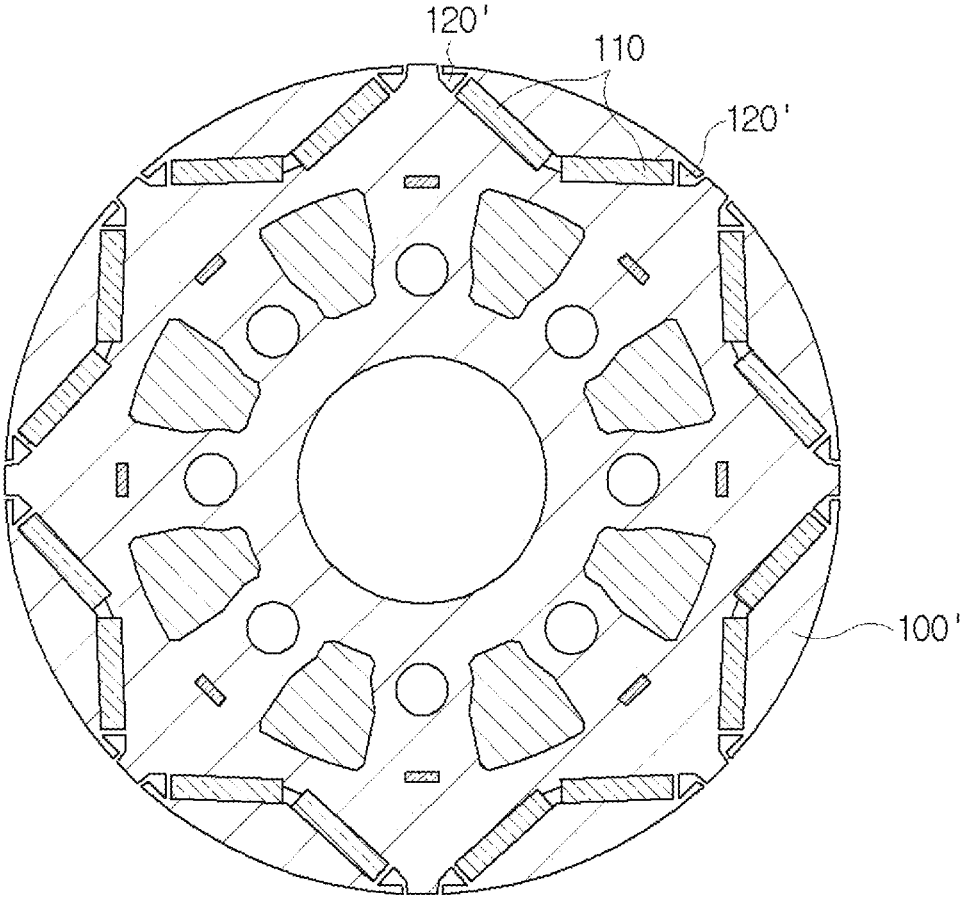
FIG. 11 is a cross-sectional view showing a rotor in an electric compressor according to a third embodiment of the present disclosure.

FIG. 11 is a cross-sectional view showing a rotor in an electric compressor according to a third embodiment of the present disclosure. FIG. 12 is an enlarged cross-sectional view of FIG. 11. FIG. 13 is a perspective view showing the rotor in the electric compressor according to the third embodiment of the present disclosure.

Figure 12:
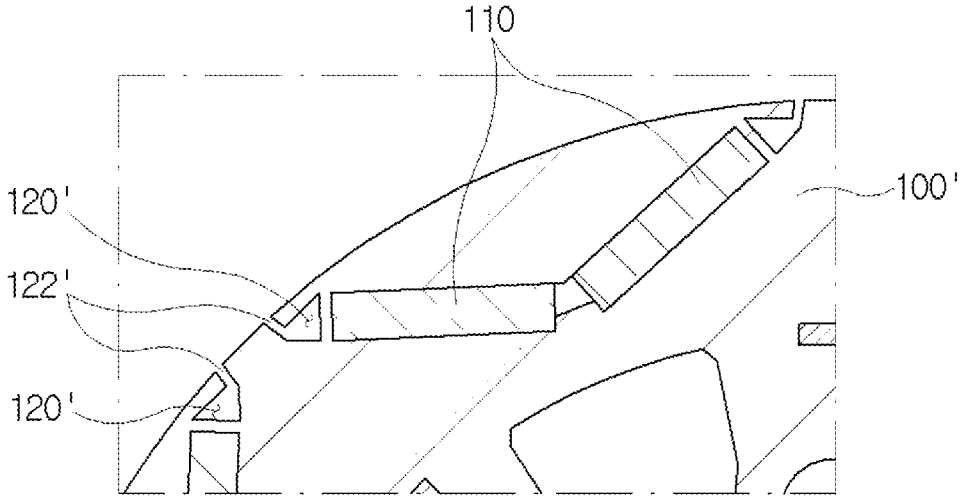
FIG. 12 is an enlarged cross-sectional view of FIG. 11.
Figure 13:
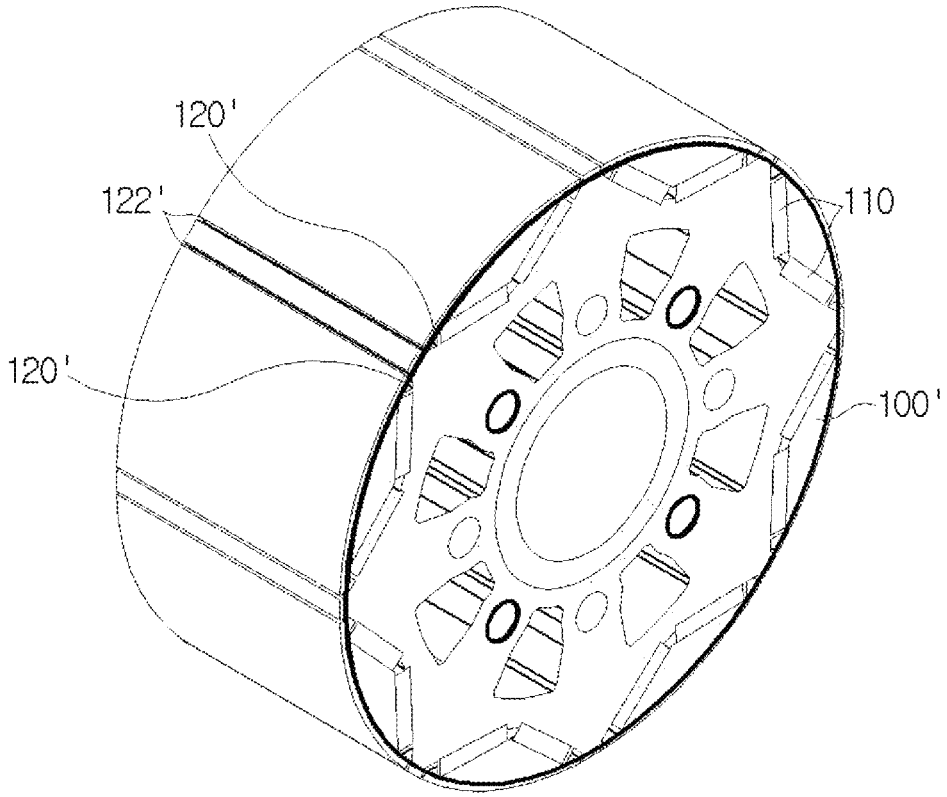
FIG. 13 is a perspective view showing the rotor in the electric compressor according to the third embodiment of the present disclosure.

As shown in FIGS. 11 to 13, in the electric compressor according to the third embodiment of the present disclosure, an opening 122' is formed at one side edge of a cooling hole 120' formed in a rotor 100' and communicates with the outside of the rotor 100'. The cooling hole 120' is formed at the same position as that described above in the first embodiment and allows the refrigerant to flow therethrough. However, unlike the first embodiment, the opening is formed to extend along the radially outer side of the rotor 100'. The opening is formed at an edge other than the edge located on the slot 106 side.

The opening allows the refrigerant flowing into the cooling hole 120' to flow from the outside of the rotor 100', that is, the radially outer side. Basically, the refrigerant passes through a space between the rotor 100' and the stator 21. A part of the refrigerant passing through the space flows into the cooling hole 120' to cause the permanent magnet 110 to be cooled.

According to such a structure, the refrigerant can pass at a closer distance to the permanent magnet 110, and a sufficient flow rate of the refrigerant can be secured, thereby improving the cooling effect of the permanent magnet 110. In particular, referring to FIG. 13, it can be seen that the opening extends in the longitudinal direction of the rotor 100'. Due to this, the refrigerant can enter and exit the cooling hole 120' through the opening at any section.

In the third embodiment described above, the covers 200 and 200' excluding the rotor 100', and the refrigerant through-holes 210 and 210' formed in the covers 200 and 200' are the same as those described above in the first or second embodiment.

Fourth Embodiment

Hereinafter, an electric compressor according to a fourth embodiment of the present disclosure will be described with reference to FIGS. 14 to 15.

Figure 14:
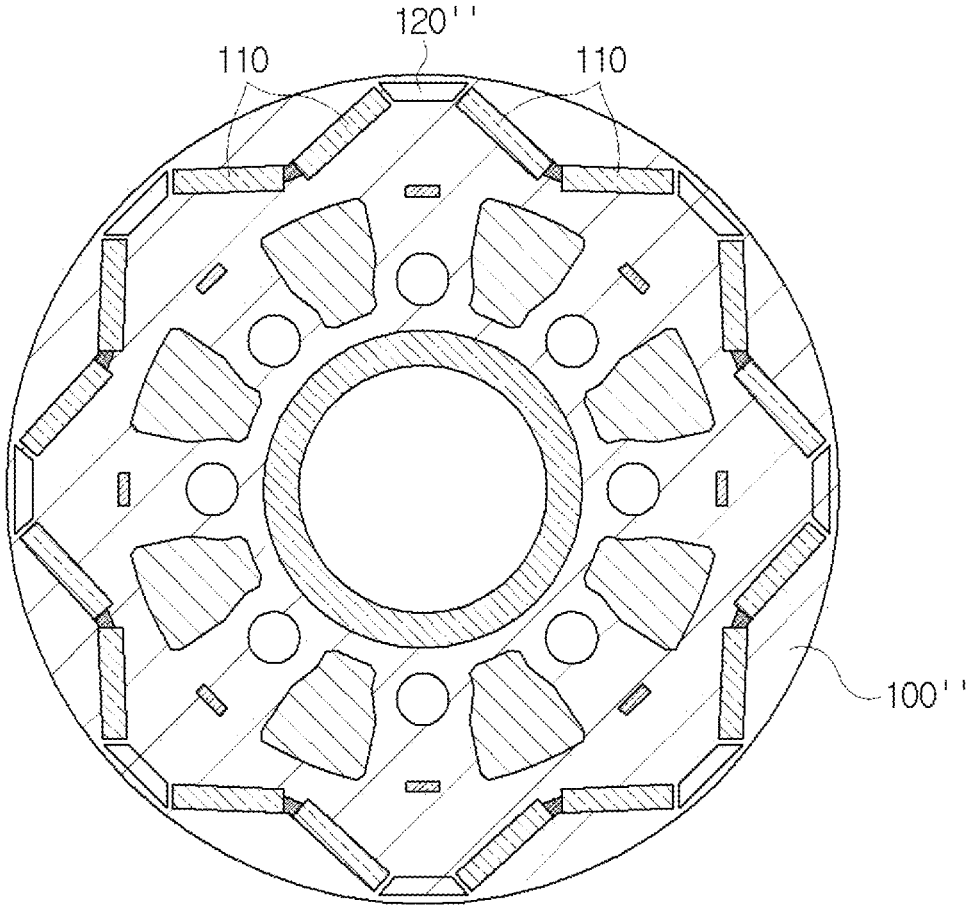
FIG. 14 is a cross-sectional view showing a rotor in an electric compressor according to a fourth embodiment of the present disclosure.

FIG. 14 is a cross-sectional view showing a rotor in an electric compressor according to a fourth embodiment of the present disclosure. FIG. 15 is an enlarged cross-sectional view of FIG. 14.

Figure 15:
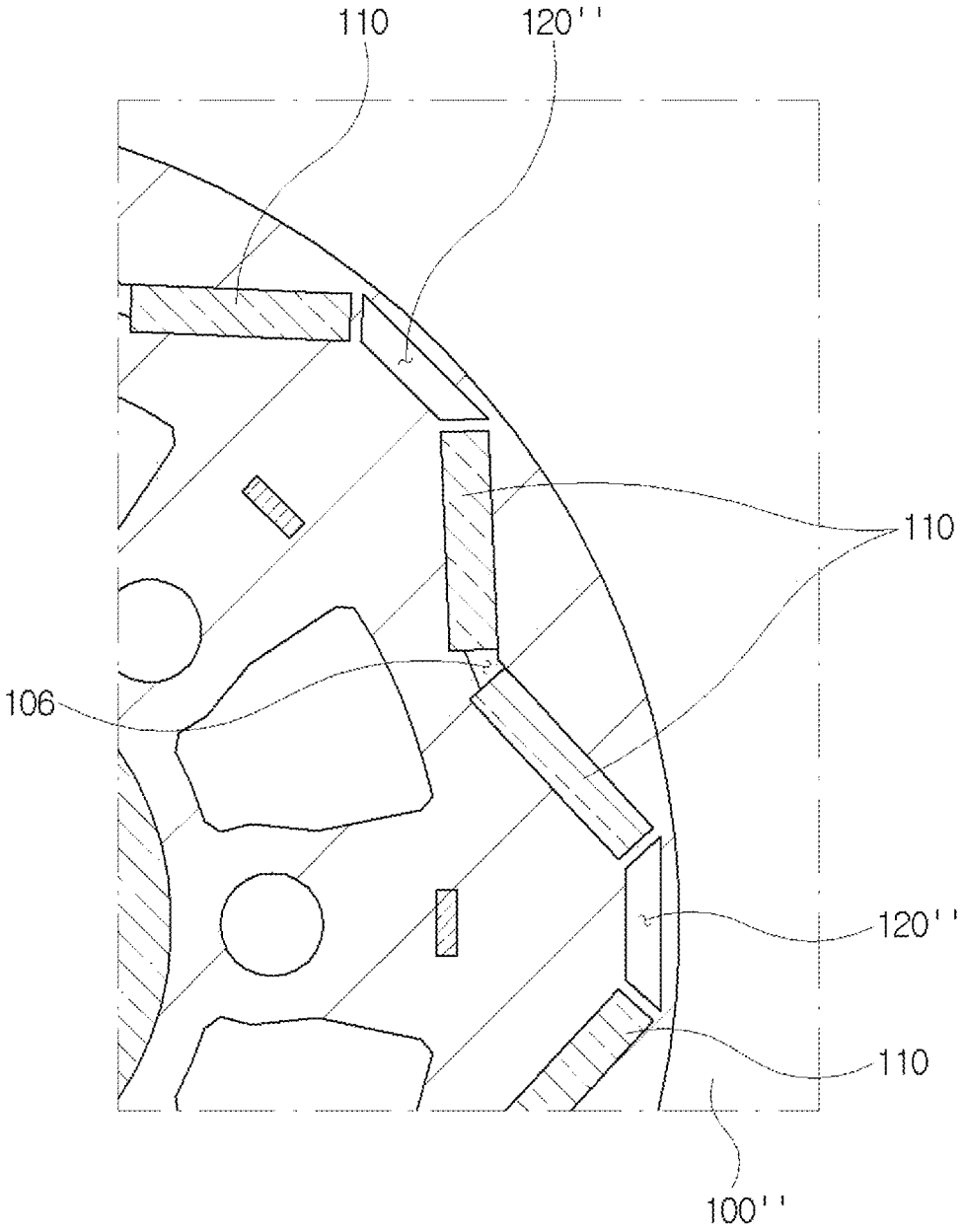
FIG. 15 is an enlarged cross-sectional view of FIG. 14.

As shown in FIGS. 14 and 15, in the electric compressor according to the fourth embodiment of the present disclosure, a cooling hole 120" formed in a rotor 100" is formed as a single space located between the two adjacent slots 106. Accordingly, the refrigerant flowing through the cooling hole 120" cools two permanent magnets 110 inserted into the two slots 106.

Specifically, the cooling hole 120" includes a first wall and a second wall which are formed on the two adjacent slot 106 sides, respectively, a third wall connecting one ends of the first wall and the second wall, and a fourth wall connecting the other ends of the first wall and the second wall. The length of the third wall is greater than the length of the fourth wall. The third wall and the fourth wall may be formed as a flat surface, and may also be formed to include curved surfaces.

The cooling hole 120" is formed as a single space between two adjacent slots 106 and is therefore large in volume. The large volume can naturally receive a large amount of refrigerant. In other words, according to the embodiment, the permanent magnets 110 can be cooled with a larger flow rate of refrigerant.

Also, compared to the first to third embodiments, the number of cooling holes 120" is reduced by a half, so that there is room for manufacturing cost reduction. Also, since the cooling holes 120" has a large size, difficulty in performing process can be reduced.

In the fourth embodiment described above, the covers 200 and 200' excluding the rotor 100", and the refrigerant through-holes 210 and 210' formed in the covers 200 and 200' are the same as those described above in the first or second embodiment.

Hereinafter, operational effects of the electric compressor according to the embodiments of the present disclosure will be described.

According to the embodiments of the present disclosure, the cooling holes 120, 120', and 120" formed in the rotors 100, 100', and 100" are formed close to the permanent magnet 110, thereby cooling the permanent magnet 110 by the refrigerant flowing through the cooling hole.

Also, according to the embodiments of the present disclosure, a large amount of flow rate of the refrigerant flowing through the cooling holes 120, 120', and 120" is obtained, so that a sufficient amount of refrigerant required to cool the permanent magnet 110 passes through.

Also, according to the embodiments of the present disclosure, the refrigerant through-holes 210 and 210' are opened to match the rotation direction of the refrigerant, so that the refrigerant can be more effectively introduced into the cooling holes 120, 120', and 120".

Accordingly, the cooling effect of the permanent magnet 110 is improved, and demagnetization caused by overheating of the permanent magnet 110 can be prevented. The prevention of the demagnetization phenomenon can stably maintain the performance of the motor without degrading the performance of the motor, so that the overall performance or reliability of the electric compressor can be enhanced.

The present disclosure relates to the electric compressor described above and has an industrial availability.

The invention claimed is:

1. An electric compressor comprising:

a compression mechanism configured to include a fixed scroll and an orbiting scroll disposed to be engaged with the fixed scroll;

a rotating shaft configured to drive the orbiting scroll;

a rotor configured to have a rotating shaft through-hole into which the rotating shaft is inserted;

a cover configured to cover a longitudinal end of the rotor; and a stator configured to be installed on a radially outer side of the rotor, wherein a plurality of slots into each of which a permanent magnet is inserted is formed in the rotor in a circumferential direction of the rotor, wherein a cooling hole is formed in both ends of the slot, and a partition wall is formed between the slot and the cooling hole, wherein refrigerant flows into the cooling hole, wherein a refrigerant through-hole communicating with the cooling hole is formed in the cover, wherein a balance weight is attached to the cover, and wherein an outer circumference of the balance weight is positioned more inward than an outer circumference of the refrigerant penetration hole in a radial direction of the rotor such that the refrigerant through-hole is opened.

2. The electric compressor of claim 1, wherein the refrigerant through-hole is opened in such a manner as to be inclined by a protrusion protruding from the cover, and wherein the refrigerant through-hole is formed by opening one side of the protrusion protruding from the cover.

3. The electric compressor of claim 2, wherein the refrigerant through-hole is opened in a direction matching a rotation direction of the refrigerant.

4. The electric compressor of claim 2, wherein, in order to avoid interference with the protrusion, the balance weight is formed by combining a plurality of metal layers of which a portion of edges is curved, and the metal layers adjacent to the cover are formed such that a curved edge is positioned more inward than the protrusion in a radial direction of the rotor.

5. The electric compressor of claim 4, wherein the balance weight further comprises:

a first stage which is composed of a metal layer adjacent to the cover and forms the curved edge more inward than the protrusion in the radial direction of the rotor; and a second stage which is connected to the first stage on an opposite side of the cover and extends outward in the radial direction of the rotor to form the curved edge corresponding to an outer surface of the cover.

6. The electric compressor of claim 1, wherein the cooling hole further comprises:

a first wall formed on a slot side;

a second wall formed in the circumferential direction of the rotor; and a third wall connecting the first wall and the second wall, wherein the first wall and the slot are spaced.

7. The electric compressor of claim 6, wherein an edge formed when the second wall and the third wall meet each other is formed to be opened, so that the refrigerant flowing outside the rotor is able to flow into the cooling hole.

8. The electric compressor of claim 1, wherein the cooling hole is formed as a single space located between two adjacent ones of the slots, so that the refrigerant flowing through the cooling hole cools the permanent magnet located on both sides of the cooling hole.

9. The electric compressor of claim 8, wherein the cooling hole further comprises:

a first wall and a second wall which are formed on sides of the two adjacent ones of the slots, respectively;

a third wall connecting a first end of the first wall and the second wall; and a fourth wall connecting a second end of the first wall and the second wall.

10. The electric compressor of claim 8, wherein a refrigerant through-hole communicating with the cooling hole is formed in the cover.

11. An electric compressor comprising:

a compression mechanism configured to include a fixed scroll and an orbiting scroll disposed to be engaged with the fixed scroll;

a rotating shaft configured to drive the orbiting scroll;

a rotor configured to have a rotating shaft through-hole into which the rotating shaft is inserted;

a cover configured to cover a longitudinal end of the rotor; and a stator configured to be installed on a radially outer side of the rotor, wherein a plurality of slots into each of which a permanent magnet is inserted is formed in the rotor in a circumferential direction of the rotor, wherein a cooling hole is formed in both ends of the slot, and a partition wall is formed between the slot and the cooling hole, wherein refrigerant flows into the cooling hole, wherein a refrigerant through-hole communicating with the cooling hole is formed in the cover, wherein the refrigerant through-hole is opened in such a manner as to be inclined by a protrusion protruding from the cover, and wherein the refrigerant through-hole is formed by opening one side of the protrusion protruding from the cover, wherein a balance weight is attached to the cover, and wherein, in order to avoid interference with the protrusion, the balance weight is formed by combining a plurality of metal layers of which a portion of edges is curved, and the metal layers adjacent to the cover are formed such that a curved edge is positioned more inward than the protrusion in a radial direction of the rotor.

* * * * *